US012471712B2

(12) United States Patent
Richards

(10) Patent No.: US 12,471,712 B2
(45) Date of Patent: Nov. 18, 2025

(54) STORAGE UNIT ATTACHABLE TO AN OBJECT

(71) Applicant: Audrey Richards, Chicago, IL (US)

(72) Inventor: Audrey Richards, Chicago, IL (US)

( * ) Notice: Subject to any disclaimer, the term of this patent is extended or adjusted under 35 U.S.C. 154(b) by 107 days.

(21) Appl. No.: 18/198,521

(22) Filed: May 17, 2023

(65) Prior Publication Data

US 2024/0382004 A1 Nov. 21, 2024

(51) Int. Cl.
*A47F 7/00* (2006.01)
*A47C 7/62* (2006.01)

(52) U.S. Cl.
CPC ..... *A47C 7/622* (2018.08)

(58) Field of Classification Search
CPC ..... A45C 7/0095; A45C 11/008; A45C 13/02; A45C 11/00; A45C 11/24; A45C 13/04; A45C 2011/007; A45C 2013/026; A45C 7/0059; Y10S 190/901; Y10S 190/903; Y10T 29/49826; A47C 7/62; A47C 7/622; A45D 44/02; A45D 44/04
See application file for complete search history.

(56) References Cited

U.S. PATENT DOCUMENTS 4,807,929 A * 2/1989 Balsbaugh ..... A47C 3/04 297/239
5,813,354 A * 9/1998 Scott ..... B60N 3/004 297/146
6,113,454 A * 9/2000 Mitchell ..... A63H 33/00 446/486
7,954,639 B2 * 6/2011 Carney ..... A63B 71/0036 211/60.1
8,459,473 B2 * 6/2013 Wang ..... A47B 43/003 211/85.3
8,540,089 B2 * 9/2013 Wang ..... A47B 43/003 211/85.3
8,763,971 B1 * 7/2014 Wilson ..... A61M 16/021 211/113
9,072,362 B2 * 7/2015 Gallup ..... A47F 5/01
9,826,812 B2 * 11/2017 Sterling ..... A45D 44/02
10,117,515 B2 * 11/2018 Osweiler ..... H05K 5/0217
10,368,641 B2 * 8/2019 Osweiler ..... A47C 7/622
2005/0247653 A1 * 11/2005 Brooks ..... A47F 5/0846 211/94.01
2006/0043090 A1 * 3/2006 Ferrini ..... B65D 90/00 220/6
2006/0082197 A1 * 4/2006 Luce ..... A47C 7/62 297/188.18
2006/0243785 A1 * 11/2006 Wang ..... B65D 5/48026 229/162.1
2009/0001089 A1 * 1/2009 Britt ..... B65D 88/1668 220/666
2009/0184077 A1 * 7/2009 Curet ..... A45D 44/04 211/113

(Continued)

*Primary Examiner* — Shin H Kim
(74) *Attorney, Agent, or Firm* — Chiacchio IP, LLC; Theodore J. Chiacchio

(57) ABSTRACT

Described herein are storage units attachable to an object. The storage units may comprise a platform. The platform may comprise a plurality of arms, a shoulder adjoined to each arm, and an adjoining member attached to each shoulder. The platform may further comprise a connecting element attached at each end to each arm. The storage units described herein may comprise one or more storage subunits attached to one or more of the arms.

6 Claims, 2 Drawing Sheets

(56) References Cited

U.S. PATENT DOCUMENTS

| | | | | |
|---|---|---|---|---|
| 2009/0212606 | A1* | 8/2009 | Bunch | A47C 1/143 297/188.14 |
| 2011/0248531 | A1* | 10/2011 | Powell | A47C 1/11 297/163 |
| 2012/0212019 | A1* | 8/2012 | Rodriguez | A47C 31/11 297/219.1 |
| 2013/0147240 | A1* | 6/2013 | Lee | A47C 7/00 297/188.05 |
| 2014/0021091 | A1* | 1/2014 | Egli | A45C 11/16 206/736 |
| 2014/0262851 | A1* | 9/2014 | Adler | A45C 11/24 29/428 |
| 2015/0360813 | A1* | 12/2015 | Lieber | B65D 5/36 220/529 |
| 2016/0157619 | A1* | 6/2016 | Demosthene | F16B 1/00 297/228.13 |
| 2016/0251153 | A1* | 9/2016 | Navalon Simon | B65D 88/522 220/1.5 |
| 2016/0374447 | A1* | 12/2016 | Sterling | A61L 2/10 34/275 |
| 2017/0340077 | A1* | 11/2017 | Millen | A45C 7/0095 |
| 2018/0070726 | A1* | 3/2018 | Osweiler | A47C 1/11 |
| 2019/0038026 | A1* | 2/2019 | Osweiler | H05K 5/0213 |
| 2019/0099028 | A1* | 4/2019 | Felsenthal | A47G 29/087 |
| 2020/0317419 | A1* | 10/2020 | Johnson | B65D 81/03 |
| 2020/0383741 | A1* | 12/2020 | Lin | A61B 46/00 |
| 2021/0145152 | A1* | 5/2021 | Rey | A45D 44/02 |
| 2023/0332063 | A1* | 10/2023 | Felsenthal | A45C 7/0095 |

* cited by examiner

STORAGE UNIT ATTACHABLE TO AN OBJECT

TECHNOLOGICAL FIELD

The present disclosure relates to storage units attachable to chairs, shower stalls, and other objects that may be positioned in close proximity to a user of items housed within the storage unit.

BACKGROUND

In hair salons, hair ovens and other equipment often present risks of burning or other injury to those working nearby. Risk of such injury may be mitigated by positioning tools used by hair stylists and others in close proximity to them to reduce the amount of reaching and other movement in the immediate vicinity of the potentially dangerous items and conditions. In other environments as well, being able to position items in close proximity to a user may mitigate risk of injury due to potentially hazardous conditions in the immediate environment. For example, when showering, being able to position items such as shampoo and soap in close proximity to a user of such items may minimize risk of slipping.

Aside from potential injury, in many professional and other environments, positioning items in close proximity to a user of such items increases convenience and, therefore, efficiency.

Safety, convenience, and efficiency, may further be enhanced by housing as many items as possible within a single storage unit. By housing more items within the storage unit, the amount of reaching and other physical movement by a user of such items is likely to decrease.

To help ensure that the storage unit is positioned in as close proximity as possible to the user, the storage unit may be attachable to an object located near the user such as, without limitation, a chair or a shower stall.

What is needed is a storage unit, attachable to an object, for housing one or more items that may be accessed by a user of such items in close proximity to the storage unit. What is needed is a storage unit, attachable to an object, where the positioning of the storage unit mitigates risk of injury to a user of items housed within the storage unit. What is needed is a storage unit, attachable to an object, where the positioning of the storage unit enhances convenience and, therefore, efficiency for a user of items housed within the storage unit.

SUMMARY

Described herein are embodiments of storage units attachable to an object, such as, for example, a chair, a shower stall, or a door. The storage units described herein may comprise a platform comprising two arms, a shoulder adjoined to each arm, and an adjoining member attached to each shoulder. The storage units described herein may further comprise a connecting element attached at each end to each arm, thereby connecting the arms. The storage units described herein may further comprise one or more storage sub-units attached to each of the arms. Each arm of the platform may be adjustable in length. The connecting element may also be adjustable in length thereby adjusting the amount of space between the arms. The storage sub-units may further comprise ultraviolet light emitting diodes for sanitizing items placed in the storage sub-units.

DETAILED DESCRIPTION

Figure 1:
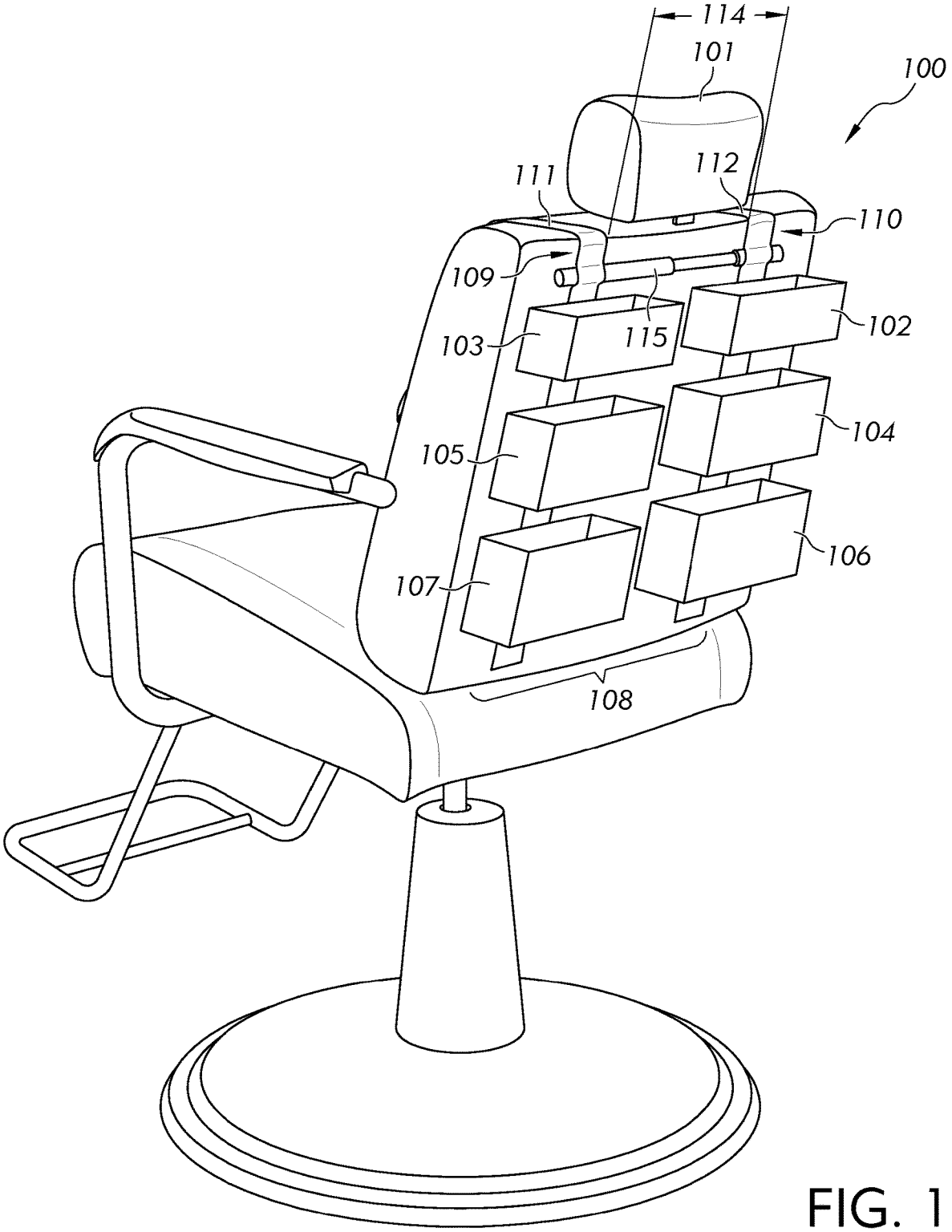
FIG. 1 represents a front perspective view of a storage unit as described herein attached to the back of a chair.
Figure 2:
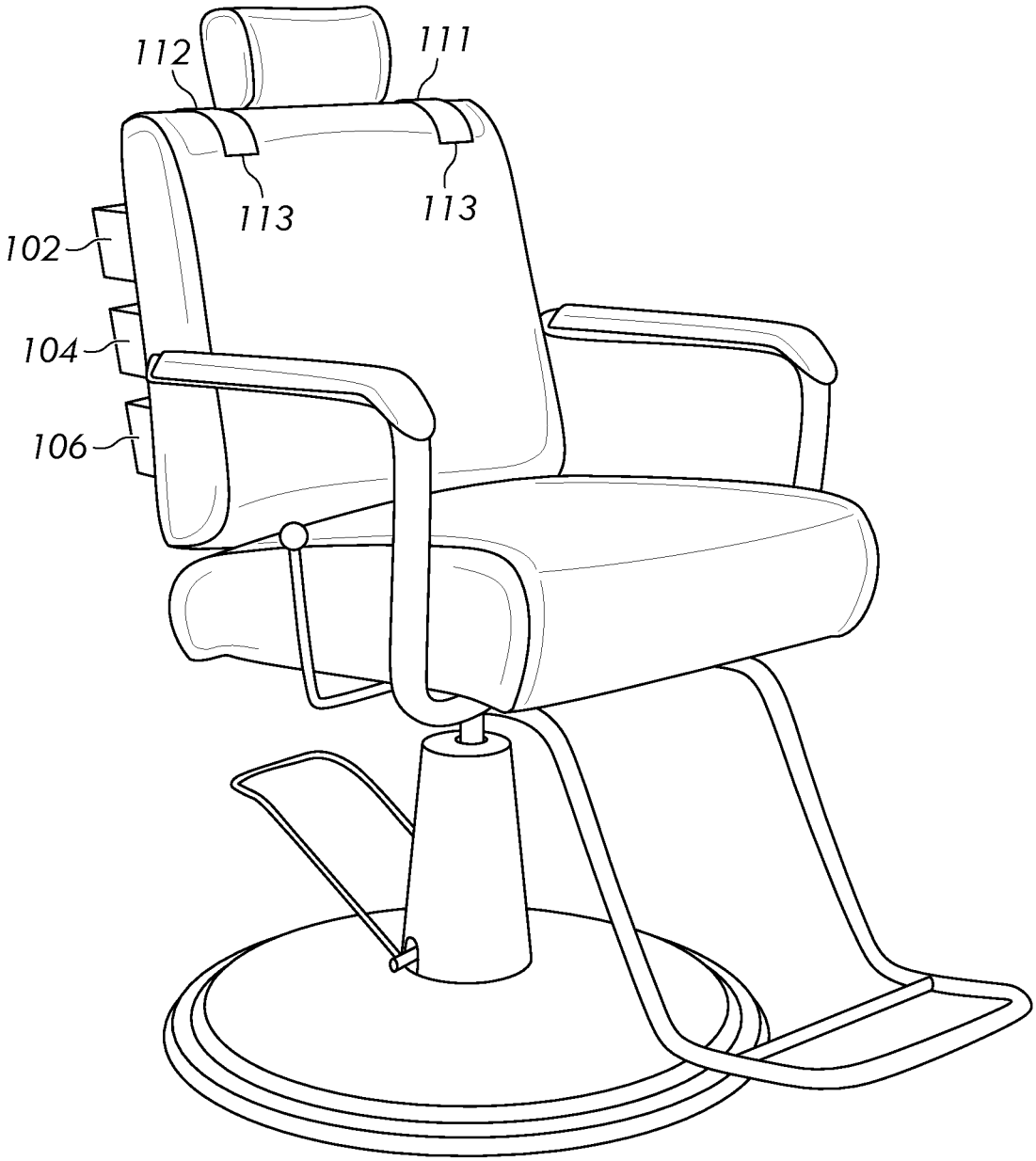
FIG. 2 represents a rear perspective view of a storage unit as described herein attached to the back of a chair.

The following disclosure concerns embodiments of a storage unit 100 attachable to an object 101. Attachable storage units as described herein may include any number of sub-units. In an embodiment, and as depicted in FIG. 1, the storage units may include six sub-units, 102, 103, 104, 105, 106, 107. Those of skill in the art will appreciate that more or fewer sub-units may be included in various embodiments, without limitation.

Storage sub-units as described herein may be substantially the same size as one another or may vary in size. The storage sub-units may be substantially the same shape as one another or may vary in shape. The storage sub-units may be virtually any size and shape that are conducive to use thereof in an environment of interest.

In an embodiment, the storage sub-units may be fastened to a platform 108 comprising two or more arms 109, 110. The storage sub-units may be fastened to the arms 109, 110 using any number of fasteners. Such fasteners may include, without limitation, screws; nails; or nuts, bolts, and washers. In an embodiment, the storage sub-units may be fastened to the arms 109, 110 using hook-and-loop fasteners.

The storage sub-units may be spaced from one another in any manner that preserves the functionality contemplated herein given the object to which the storage unit will be attached and the length of the platform arm to which the sub-unit will be attached. In an embodiment, the storage sub-units may be spaced between approximately 1.5 inches and approximately 5 inches from one another, as measured from the top of a first storage sub-unit to the bottom of a second storage sub-unit. In an embodiment, the distance between storage sub-units as so measured may be approximately 1.67 inches, without limitation. Those of skill in the art will appreciate alternative spacing that may be used between the sub-units after having the benefit of this disclosure, such embodiments being included within the scope of this disclosure.

In an embodiment, the storage sub-units may be arranged in a substantially vertical alignment. In an embodiment, the storage sub-units may be arranged in a substantially circular arrangement. The storage sub-units may be arranged and fastened to the arms 109, 110 in virtually any configuration that may preserve the functionality of the storage sub-units.

In an embodiment, and as depicted in FIG. 1, the storage sub-units may be arranged in two vertical columns, with vertically-aligned storage sub-units attached to each arm 109, 110 of the platform 108.

In an embodiment, the sub-units may be repositionable to different locations along an arm of the platform. As would be readily appreciated by those skilled in the art, such repositioning may or may not involve first detaching the sub-unit from the arm and then re-attaching the sub-unit to the arm, depending on the method by which the sub-unit has been fastened to the platform arm.

In an embodiment, the storage sub-units 102, 103, 104, 105, 106, 107 may be substantially rectangular in shape and may provide an opening, for example at the top of the storage sub-unit, to allow for placing items into the sub-unit. According to such embodiment, the storage sub-units may comprise a base member and four sides. In an embodiment, each of the sides may be adjoined to one another at either end and may further be adjoined to the base member in a manner so as to define an interior space open at one end and closed at the other end such as is depicted in FIG. 1, 102, 103, 104, 105, 106, 107.

In an embodiment, substantially rectangular storage sub-units may be between approximately 5 and approximately 10 inches in length, between approximately 3 inches and approximately 7 inches in height, and between approximately 3 inches and approximately 5 inches in width. In an embodiment, the storage sub-units may be approximately 7 inches in length, approximately 5 inches in height, and approximately 4 inches in width.

In an alternative embodiment, the storage sub-units may comprise a substantially circular base member adjoined to a substantially cylindrical member comprising an opening on each end. According to such an embodiment, once the base member and the substantially cylindrical member have been adjoined, the resulting substantially cylindrical storage sub-unit may comprise one open end in which items may be placed and one closed end.

In an embodiment, the platform may comprise two arms 109, 110. Each arm may comprise a shoulder 111, 112. The shoulders 111, 112 may be substantially rectangular in shape, without limitation. In an embodiment, each shoulder may be between approximately 1.5 inches and 3 inches in length; and between approximately 1.5 inches and approximately 2 inches in width. In an embodiment, each shoulder may be 2 inches in length and 1 inch in width. In an embodiment, the arms 109, 110 may be substantially parallel to one another.

Each shoulder may further comprise an adjoining member 113. The adjoining member 113 may be between approximately three inches and approximately five inches in length; and between approximately 0.75 inches and approximately 1.5 inches in width. In an embodiment, the adjoining member 113 may be 4 inches in length and 1 inch in width. The foregoing dimensions are intended to serve as examples only and are not intended to be limiting in any way.

The storage sub-units may be detachable from, and/or attachable to, the arm.

The storage sub-units may be collapsible to facilitate transport of the storage unit and associated sub-units. In an embodiment, the sub-units may be collapsible by applying pressure upon a front facing side of the storage sub-unit toward the platform. According to such embodiment, the storage sub-units may collapse in a horizontal manner toward the platform or may, alternatively, collapse in a vertical manner toward the platform.

The platform arms 109, 110 may be adjustable. In an embodiment, each platform arm may comprise an inner component as well as an outer component encasing the inner component. According to such an embodiment, the outer components may be extended outward in a telescoping manner by applying a negative force to pull the outer component away from the shoulder. The outer component may be extended so that its end distal from the adjoining shoulder may be located between approximately 10 inches and approximately 25 inches from the adjoining shoulder. In an embodiment, the outer component may be extended so that its distal end is located between approximately 15 inches and approximately 20 inches from the adjoining shoulder of the platform.

The platform arms 109, 110 may be adjoined to one another by a connecting element 115. The connecting element 115 may be attached at each end to each platform arm, thereby connecting the arms. The connecting element 115 may be contiguous with the platform arm or may comprise a separate, detachable piece of material. The connecting element 115 may be constructed of the same material as the platform arms 109, 110 or a different material. The same types of materials that may be used to construct the platform may be used to construct the connecting element.

In embodiments where the connecting element 115 is not contiguous with the platform arms 109, 110, the connecting element 115 may be fastened to the arms 109, 110 using any number of methods, which methods would be readily envisioned by those skilled in the art. Such methods may include, without limitation, screws; nails; or nuts, bolts, and washers.

The platform arms 109, 110 may be connected to the connecting element 115 at virtually any number of locations along the connecting element 115. Accordingly, the distance between the platform arms may be configured by adjusting the locations along the connecting element 115 at which each arm is fastened. In an embodiment, the distance between the platform arms may be between approximately 10 inches and approximately 24 inches. In an embodiment, the distance between the platform arms 114 may be approximately 12 inches. Those of skill in the art after having the benefit of this disclosure will appreciate that additional distances between the platform arms are possible. Such alternative embodiments are intended to be included within the scope of this disclosure.

The platform, including the arms, shoulders, adjoining members, and connecting element may be made of virtually any number of materials. Such material may include metal, such as, for example, stainless steel, iron, or aluminum. Such material may comprise a plastic, such as, without limitation, polypropylene, polyethylene terephthalate, or polyvinyl chloride. In an embodiment, the platform may comprise material capable of hook-and-loop fastening with a complimentary material.

The storage units described herein may be attached to a chair in a hair salon or barber shop. When so used, the storage sub-units may house instruments used to cut, comb, and/or otherwise style a person's hair. The user may wish to sanitize such instruments between uses. Accordingly, storage sub-units as described herein may comprise mechanisms through which contents of the sub-units may be sanitized. In an embodiment, storage sub-units as described herein may comprise ultraviolet light emitting diodes useful for eliminating bacteria and other harmful agents that may be present on items placed in the storage sub-units.

In an embodiment, storage sub-units as described herein may comprise a plurality of light emitting diodes arranged in a substantially horizontal configuration around the perimeter of the interior of the storage sub-unit, wherein the interior may be defined by the base member and the adjoined sides. According to such an embodiment, each of the four sides defining the interior of the storage sub-unit may comprise at least one light-emitting diode.

In an embodiment, light emitting diodes may be positioned on the interior of the sides of the storage sub-unit at varying heights as measured from the base member. This embodiment may be particularly appropriate where the storage sub-units are being used to house items of various sizes and shapes because it helps to increase the likelihood that the lighting is extending to a greater area within the storage sub-units.

The storage sub-units described herein may be attached to a shower stall, a door, or virtually any other object that is capable of withstanding the force applied to it by virtue of the weight of items that may be housed within the storage sub-units.

What is claimed is:

1. A storage unit attachable to an object, wherein the storage unit comprises:

a platform comprising a one or more arms, a shoulder adjoined to each of the one or more arms, and an adjoining member attached to the shoulder;

a connecting element attached to each of the one or more arms, wherein the connecting element is adjustable in length; and one or more storage sub-units attached to the one or more arms.

2. A storage unit attachable to an object, wherein the storage unit comprises:

a platform comprising two arms, a shoulder adjoined to each of the arms, and an adjoining member attached to each shoulder;

a connecting element attached to each of the arms; and at least one storage sub-unit attached to each of the arms;

wherein the connecting element is adjustable in length; and wherein each of the arms is adjustable in length.

3. The storage unit of claim 2, wherein the storage sub-units further comprise one or more ultraviolet light emitting diodes.

4. The storage unit of claim 3, wherein the one or more ultraviolet light emitting diodes at least partially eliminate bacteria and/or harmful agents when operated.

5. The storage unit of claim 2, wherein the one or more storage sub-units are collapsible.

6. The storage unit of claim 2, wherein the one or more storage sub-units are detachable from the arms.

* * * * *